US006386530B1

(12) United States Patent
Marks

(10) Patent No.: US 6,386,530 B1
(45) Date of Patent: May 14, 2002

(54) QUICK ACTION CLAMP

(75) Inventor: Joel Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 09/635,631

(22) Filed: Aug. 10, 2000

(51) Int. Cl.[7] ..... B25B 5/02
(52) U.S. Cl. ..... 269/6; 269/170
(58) Field of Search ..... 269/3, 6, 166, 269/169, 168, 203, 204, 170; 81/487

(56) References Cited

U.S. PATENT DOCUMENTS

| | | | |
|---|---|---|---|
| 4,524,650 | A | 6/1985 | Marks |
| 4,739,838 | A | 4/1988 | Marks |
| 4,874,155 | A | 10/1989 | Goul |
| 4,926,722 | A | 5/1990 | Sorenson |
| 5,005,449 | A | 4/1991 | Sorenson |
| 5,009,134 | A | 4/1991 | Sorenson |
| 5,022,137 | A | 6/1991 | Sorenson |
| 5,161,787 | A | 11/1992 | Hobday |
| 5,853,168 | A | 12/1998 | Drake |

FOREIGN PATENT DOCUMENTS

| | | |
|---|---|---|
| CO | 1555455 | 11/1979 |

*Primary Examiner*—Robert C. Watson
(74) *Attorney, Agent, or Firm*—Brad I. Golstein

(57) ABSTRACT

A bar clamp operates by squeezing a handle to close a jaw. The improvements of the present invention include: low actuation force, two speed action to provide both high speed closing and high force clamping, a removable bar to allow different length bars to be installed into one body, a side mounted bar release button which allows easy access and an increased handle stroke, and reinforced wedge elements.

25 Claims, 10 Drawing Sheets

QUICK ACTION CLAMP

FIELD OF THE INVENTION

The present invention relates to clamping tools. More precisely the present invention relates to one hand squeeze operated bar clamp tools using wedges to bind a bar.

BACKGROUND OF THE INVENTION

Squeeze operated clamps are well known. The related art uses an elongated plate to bind a bar at an angle to create a drive or locking action. A familiar application of this method is shown in British Patent 1555455 which shows a caulking gun device. A driving plate 41 and a locking plate 51 are fitted around a shaft. Each plate has a biasing spring also surrounding the shaft.

U.S. Pat. Nos. 4,926,722, 5,009,134 and 5,022,137 are some of a series to J. Sorensen et al covering a squeeze operated bar clamp. A locking plate is positioned in front of a trigger handle. A compression spring surrounds the bar and presses a drive plate forward. The drive plate and drive spring are held in position by the bar. In FIG. 9 of '134 a locking plate is shown behind the trigger handle.

U.S. Pat. No. 5,005,449 shows a further version of a squeeze actuated clamp in which the trigger handle is parallel to the bar and the handle is squeezed toward the bar.

U.S. Pat. No. 5,161,787 shows in FIG. 3 a shaft driving apparatus. A two speed action is provided through the use of a flexible linkage 90 and a rigid linkage 75. The leverage from handle 34 depends upon the force required of bar 26. The bar moves the opposite direction from the handle motion. Compression spring 38 is surrounded at its non-moving end by ribs of the body structure. The other spring end which presses the drive plate is positioned only by the bar passing within the spring.

U.S. Pat. No. 5,853,168 shows a clamp similar to that of Sorensen except that the clamping jaws point down and the locking plate extends upward directly above the trigger handle. The drive and lock plates are positioned within the housing by a rib 31. The drive plate bias spring 22 is positioned in a similar manner to '787 above. As seen in FIG. 2 of '168 the front end of spring 22 is held in position only by bar 12.

U.S. Pat. No. 4,874,155 shows a C-clamp where locking plate release 13 faces rearward. The lock plate spring is positioned around the bar. A drive plate spring is mounted to a shaft separate from the bar. The bar moves in the opposite direction from the handle motion.

In U.S. Pat. Nos. 4,524,650 and 4,739,838, a varying speed lever mechanism for a screwdriver is disclosed. The levers include various sliding and pivoting linkages.

In the clamping devices general design types are seen. One type is a C-clamp where the body of the tool is C shaped. The bar moves oppositely from the trigger handle mounted at the base of body. A caulking gun is also in this category. A second version is a bar clamp where the bar is drawn toward the body in the same direction as the handle is moved. The present invention is directed to the pistol grip bar clamp. In a pistol grip design a part of the housing body extends downward in parallel to a trigger handle such that the handle extends substantially perpendicular to the movable bar. The jaws may be above or below the bar in a pistol grip design. The mechanical limitations and requirements are different between a C clamp and a bar clamp.

SUMMARY OF THE INVENTION

The present invention provides several improvements to the function of a one hand squeeze operated bar clamp. The bar and jaw end are both easily removable so that a different length bar can be used with the same tool body. The bar advance action is very fast without loss of clamping force. An easily accessed and intuitive release button is positioned at the side of the tool. The design is comfortable to hold and operate. The drive and lock wedge plates are strengthened by use of a bent channel cross section. A torsion spring is used to bias the drive wedge to allow minimal resistance through a long drive stroke.

The improvements of the present invention may also be of benefit to caulking guns and other such devices.

The bar is entirely separable from the clamp components. A user can easily install a longer bar without the need to purchase another complete clamp. In addition the bar can be pulled out and inserted into the rear; if the jaw end is reversed to face away from the clamp body and attached to the bar behind the body a spreading device is created. An improvement of the invention is that when the bar is removed the internal components will not fall out of position. In particular the drive and lock wedges, and the bias spring do not depend on the bar to hold them in position. In a preferred embodiment the wedges are contained entirely within the body, with the locking wedge linked to a release button or lever. Ribs or notches of the housing body contain the wedges vertically, and the housing walls contain them horizontally. In a preferred embodiment the bias spring is a torsion spring with one spring end pressing behind the drive wedge. The spring coil is supported around a post or feature in the housing. The spring end is therefore also positioned within the housing and does not depend on the bar to be secure. In an alternate embodiment the spring is a compression spring surrounding the bar, where one end is secured within the housing and the other end presses and moves with the drive wedge. The other end of the compression spring may be held by various means in position against the wedge as described later.

A prior art spring is shown in FIG. 3 of U.S. Pat. No. 5,161,787. In this design the spring is secured only at its non-moving end. The ribs surrounding the spring extend well short of drive plates 68. If the spring is to remain stable when the bar is removed the space between the drive plates and the ribs around the fixed end of the spring must be small. The drive stroke must also then be small. If the space is large enough to enable large wedge plate motion and bar speed, then the spring will have a long unsupported end near the plates when the bar is removed. Especially if the tool is bumped or dropped with the bar removed the spring will fall out of position at the plate and it will be difficult to reinstall the bar. Therefore while both U.S. Pat. Nos. 5,161,787 and 5,853,168 disclose methods to hold wedging plates in position with the bar removed, neither provides a reliable solution to-hold the spring.

The drive action of the present invention has a long stroke to enable fast closing. This makes it unnecessary to use a second hand to close the jaw. To maintain a reasonable grip distance the leverage from the handle to close the jaw varies according to the-handle position. In its more extended position the handle provides high leverage and therefore high closing force. As the handle is squeezed rearward the relative speed of the bar increases. In the rear portion of the handle travel a small squeeze motion produces a large bar motion. Both high speed and high force are provided by use of varying leverage with a moving fulcrum. No complex linkages are required. The mechanism operates with low friction.

To make a high speed action practical the device must operate efficiently. Efficiency in this case comprises: low friction, full use of a hand grip distance, and comfortable features and shape.

Another improvement of the invention is the side located release button. The locking wedge is enclosed within the housing and is linked to the user by the release button. The button is accessible by the thumb when the tool is used right handed. All of the fingers on the trigger handle can remain in place as the release is engaged. However the button is also positioned to facilitate left hand use where testing has shown that the middle finger can easily reach back to operate it. Either way this easy access helps when doing fine adjustments where alternate clamping and releasing actions are needed.

Also of importance is the release operation as it is often performed in real applications. Most typically an object is being held to a horizontal surface and the clamp faces downward. With the side release button a user grabs the tool body, squeezes the release button and pulls the tool away. This occurs as one continuous motion.

The prior art releases on the back or top are not convenient for one hand use. Particularly for the pistol grip bar clamp there is no way for the gripping hand to access such releases.

A release lever in front of the handle requires a reduction in usable handle travel in the pistol grip design. The release lever will define the total gripping distance. The trigger handle. that is behind the release lever must then be less than this total gripping distance. This leads to a wasted opportunity when it is desired to have the fastest and easiest possible operation wherein all of a user's practical grip motion should be used to advance the bar. The distance between the release lever and the trigger handle defines the wasted opportunity of handle motion. Although a small handle motion can be amplified to a large bar motion by appropriate leverage, the faster motion leverage requires higher squeezing effort.

Observation of inexperienced users has indicated another disadvantage to the forwardly positioned release lever. The release lever resembles an operating handle and initial users squeeze the release lever when the intent is actually to advance the bar. After it does not work as expected the user must study the tool to locate the actual trigger handle. In U.S. Pat. No. 5,009,134 FIG. 9 shows an alternate embodiment clamp with a locking lever behind the handle "where preventing inadvertent activation of the braking lever is desired" (Col. 5, lines 52–55). However the locking lever of FIG. 9 is not easily accessed. A more intuitive design for the release device is needed.

Another improvement of the present invention is the balance and comfort of holding the tool. The tool body and handle provide surfaces to support the tool on the hand with the hand in a natural position. Especially with the bar extended the handle extension provides support for the cantilevered weight of the handle.

DETAILED DESCRIPTION OF THE ILLUSTRATED EMBODIMENT

Figure 1:
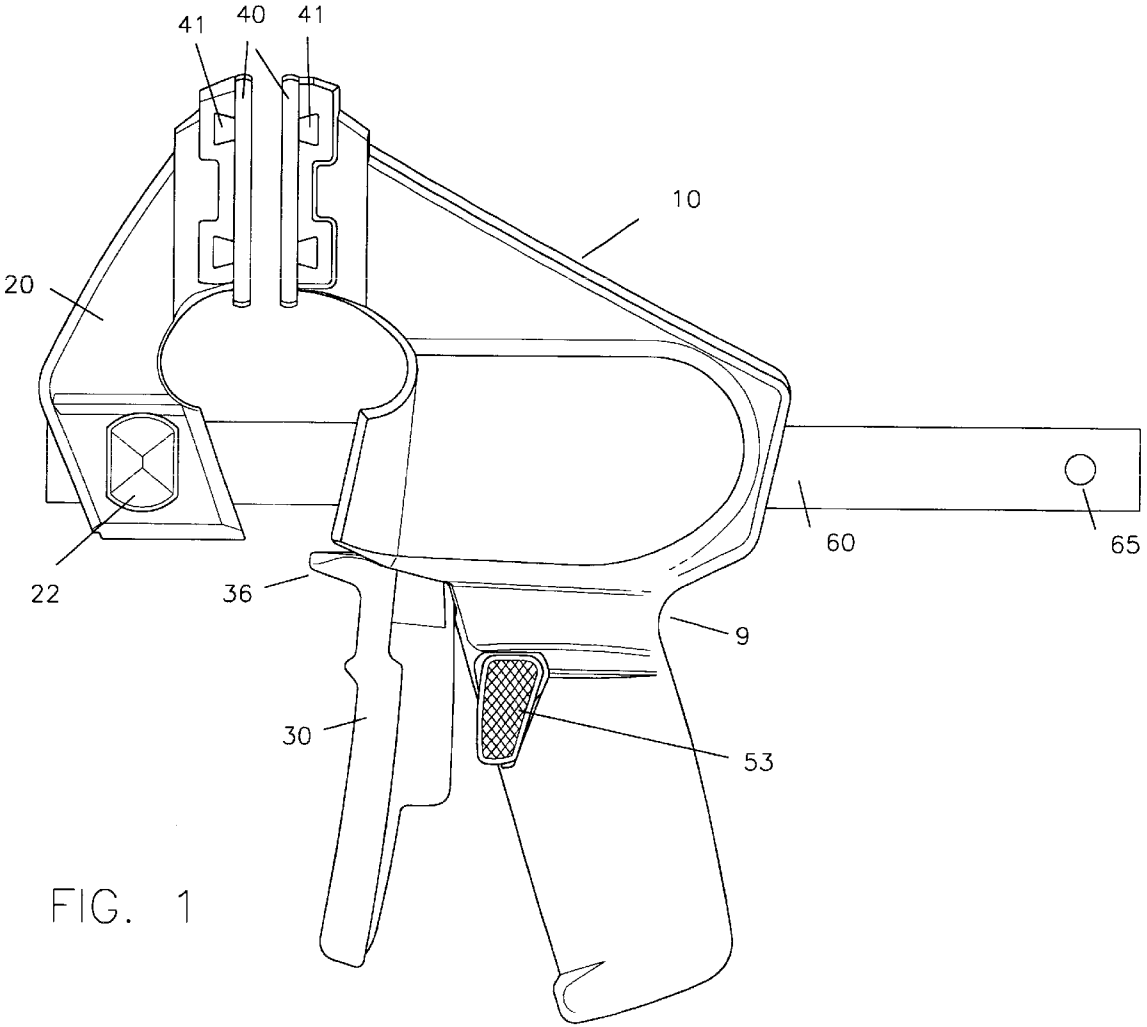
FIG. 1 is a side elevation of a quick action clamp according to one embodiment of the invention.

FIG. 1 shows a general view of a preferred embodiment clamp. A housing body 10 supports pivotable handle 30. Housing 10 band handle 30 may be molded plastic or die cast metal. In the case of plastic a glass filled nylon or polycarbonate may be used. Bar 60 is slidably disposed through the central portion of housing 10. Release button 53 is on at least one side of housing 10, to the rear of handle 30. Jaw end 20 is releasably held to bar 60 by knob 22. Rubber pads 40 may be fitted to the two facing clamping surfaces and held to the tool by ribs 41 engaging corresponding slots. Ribs 41 may have a "dovetail" shape.

Figure 2:
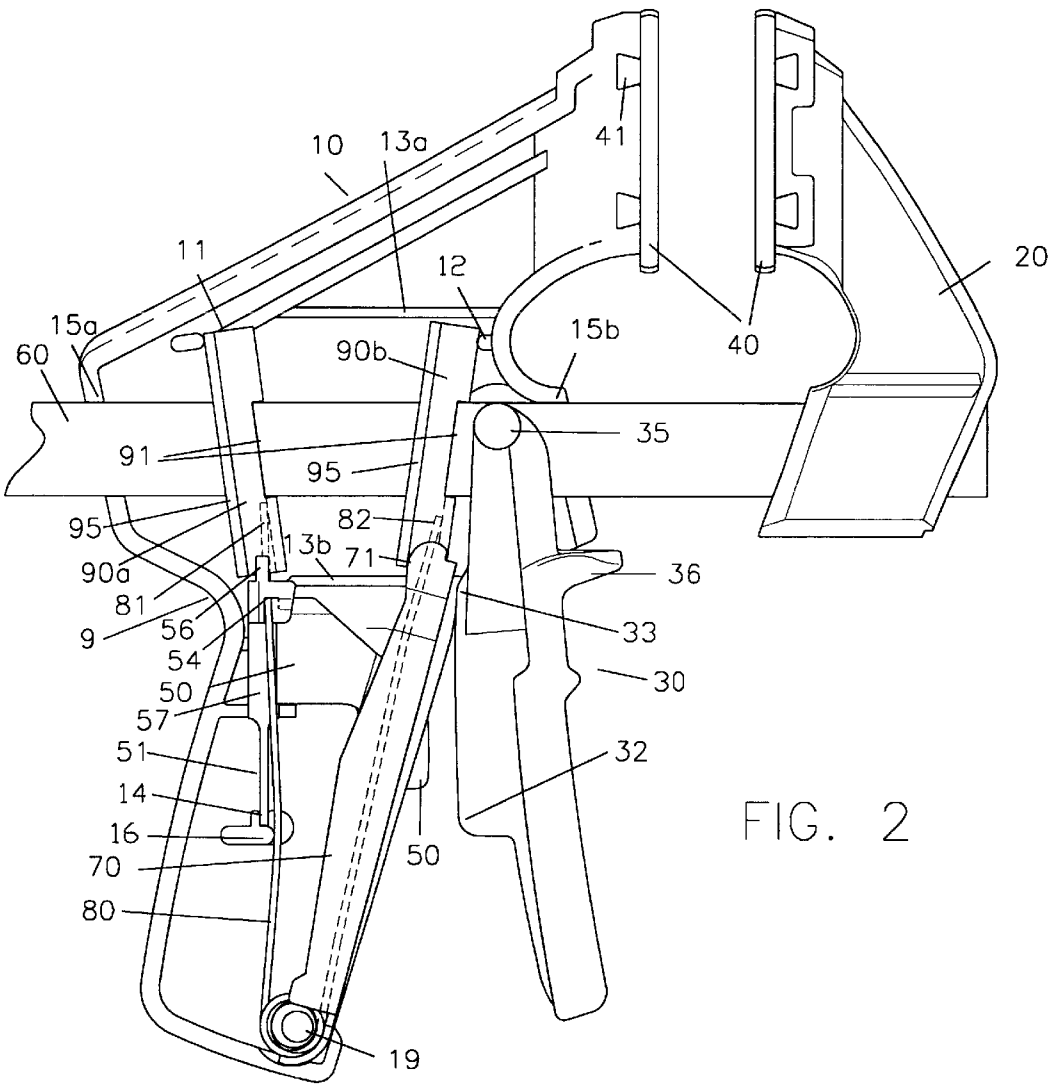
FIG. 2 is the clamp of FIG. 1, with one side of a housing body removed showing the internal components in a high force mode, with a handle fully extended.
Figure 3:
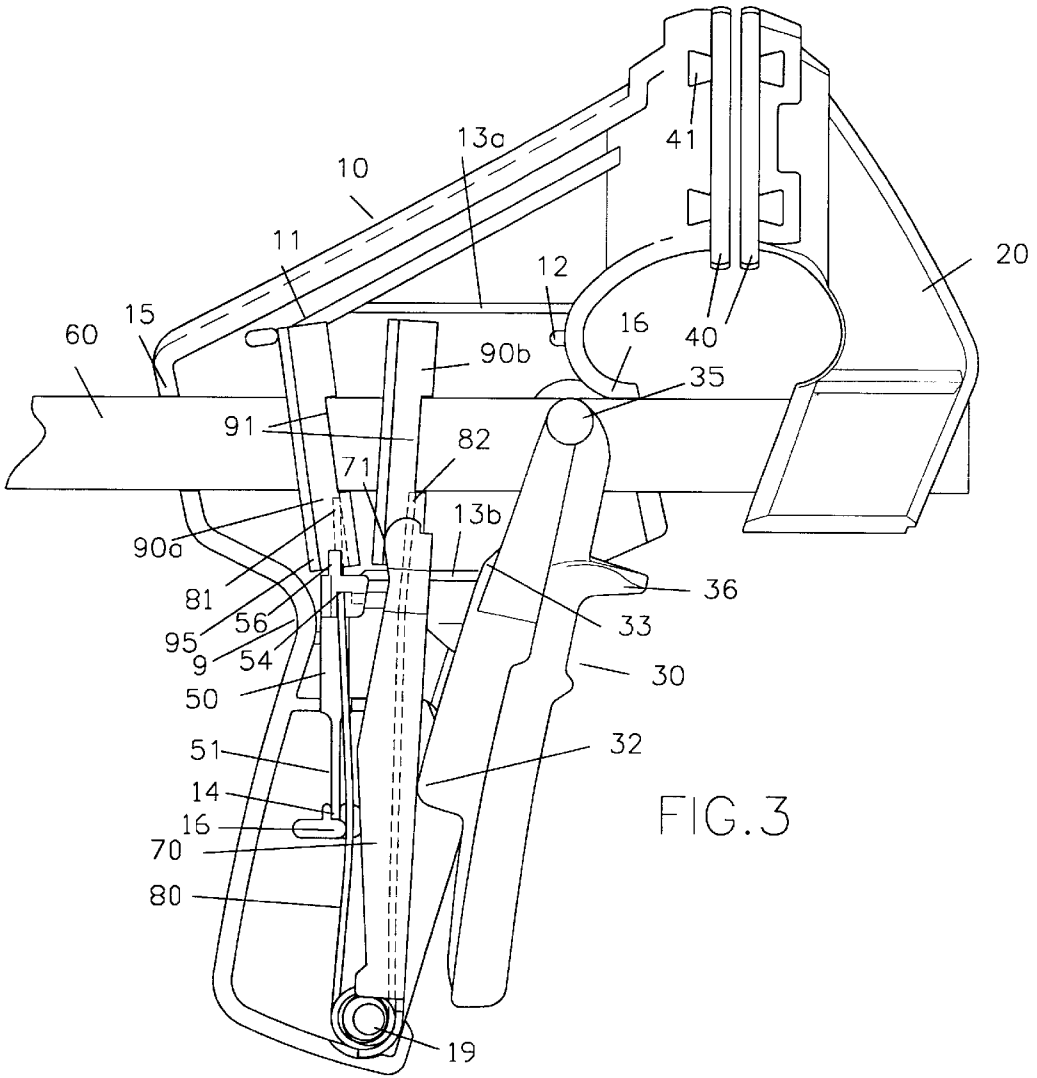
FIG. 3 is the clamp of FIG. 2 in a high speed mode, with the handle depressed and a jaw end advanced toward the body.
Figure 14:
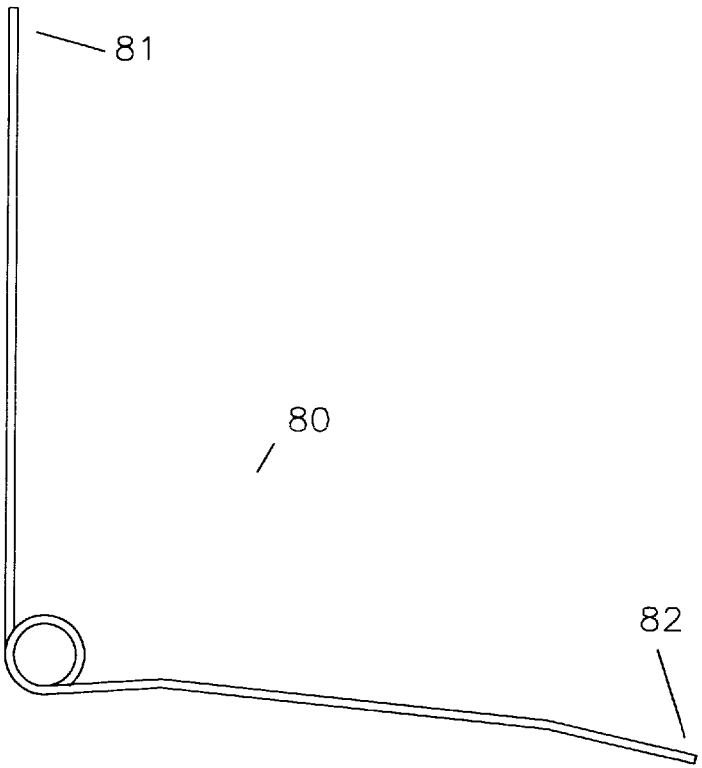
FIG. 14 is a side elevation of a torsion bias spring.
Figure 13:
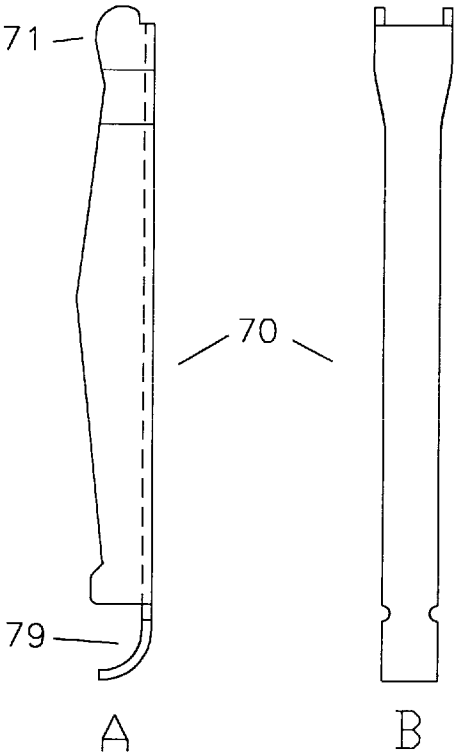
FIGS. 13A and B are side and front elevations respectively of a lever.
Figure 16:
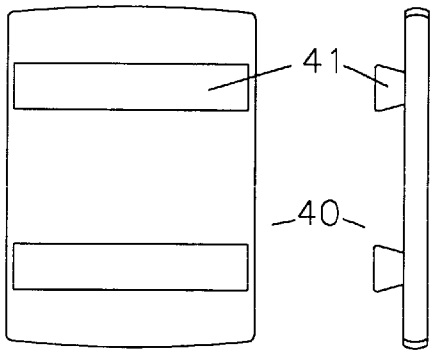
FIGS. 16A and B are plan and side elevations respectively of a jaw pad.
Figure 15:
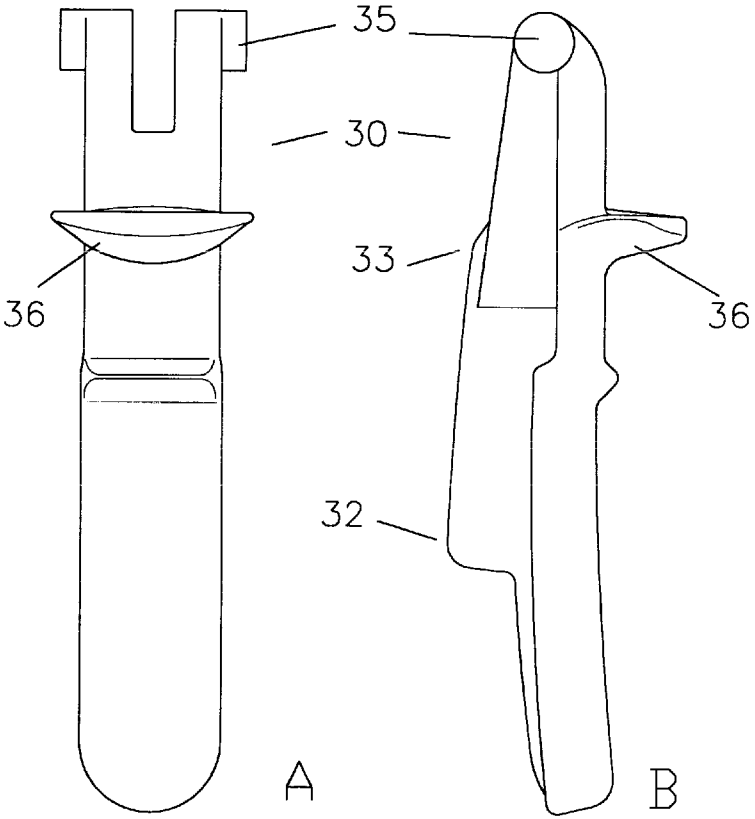
FIGS. 15A and B are front and side elevations respectively of a handle.

FIG. 2 and FIG. 3 show the operation of the present invention clamp. Housing openings 15*a* and 15*b* guide bar 60. In FIG. 2 handle 30 is in its most extended position. Fulcrum 33 of handle 30 is adjacent to a front of channel shaped lever 70. A slight space is shown between fulcrum 33 and lever 70 to enable some freeplay so that bar 60 can slide within drive wedge 90*b* when handle 30 is not being squeezed, as described later. As handle 30 is squeezed through a front portion of the stroke fulcrum 33 presses lever 70, whereby contact 71 of the lever presses a lower end of flange 95 of wedge 90*b*. End 82 of spring 80 biases wedge 90*b* forward. Spring end 82 is positioned higher against a backside of wedge 90*b* than lever contact 71. The rearward force of lever contact 71 being below the forward force of spring end 82 causes a rotational bias upon wedge 90*b* such that wedge 90*b* remains angled as shown in FIG. 2. This angle bias is important for the later return stroke action. Spring end 82 is shown forward of contact 71, resting in the channel formed between flanges 95 of wedge 90*b*. As shown in FIG. 14 the front arm of spring 80 may include bends. These bends help ensure that only end 82 of the spring contacts any element of the mechanism, especially as the spring is deflected and the arm becomes curved such that it could touch the rear side of lever 70. Alternately the front spring arm can be straight and a slot in the face of lever 70 could provide a space for the spring arm to enter. Further a curve along the length of lever 70, convex in front, could also provide clearance for the front spring arm, as well as provide additional separation for fulcrums 32 and 33 of handle 30. However a large curve in the length of lever 70 can lead to complexity as described later.

In a preferred embodiment wedges 90 are formed in a channel section including flanges, or other out of plane shape to provide stiffness using a thin material. If a flat wedge bar were used multiple bars would be needed to have enough strength, and the spring end would not have the channel for positioning. If a flat wedge were desired however, spring end 82 could fit in a small hole or other feature of the wedge, rather than the channel, to position the spring side to side. See also discussion of FIG. 18B below for a related solution for the spring.

As handle 30 is squeezed contact 71 of lever 70 moves wedge 90*b* rearward. Contact 71 slides against wedge 90*b* just enough to compensate for the arc of rotation of lever 70 about pivot 19. Since contact 71 is not extremely frontward nor rearward of pivot 19 contact 71 will have minimal vertical movement and the sliding contact at 71 will be minimal; further linkages are not required. This is possible in part because the front face of lever 70 is straight, or at least nearly so, while the fulcrum points are generated by contours on handle 30. This contrasts with the design of U.S. Pat. Nos. 4,524,650 and 4,739,838 where the contours are on the lever element. In these designs a "curved lever" behind the handle curves substantially forward from a lower pivot mounting. Extra linkages are required to accommodate the large change in distance between the top of the lever and the lower pivot that occurs as the top of the lever moves rearward above the lower pivot point.

Figure 11:
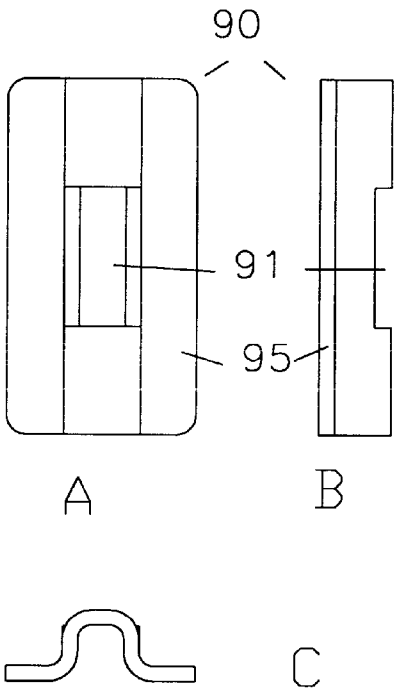
FIGS. 11A, B, and C are plan, side and end elevations respectively of a wedge bar.

Opening 91 (FIG. 11)of wedge 90*b* binds about bar 60 as handle 30 is squeezed. Bar 60 therefore moves along with wedge 90*b*. As the squeeze operation continues the relative angle between handle 30 and lever 70 changes such that handle 30 presses lever 70 at a lower position, fulcrum 32 in FIG. 3. FIG. 3 shows the end of a stroke, but fulcrum 32 remains in contact for the rear portion of the stroke.

The relative rotation speed of the handle and the lever changes as the mechanism moves between the state of FIG. 2 and that of FIG. 3. Specifically fulcrum 33 has high leverage against lever 70 in FIG. 2 since fulcrum 33 is near to handle pivot 35. In FIG. 3 the leverage of fulcrum 32 is lower since fulcrum 32 is further from pivot 35. Conversely the effective speed by which handle 30 can move lever 70, and hence bar 60, is high in FIG. 3 where fulcrum 32 is near to pivot 19. Preferably the edge of handle 30 is slightly convex between fulcrums 32 and 33 so that the transition during use is not abrupt or uncomfortable.

The effect of the "moving fulcrum" illustrated in FIG. 2 and FIG. 3 is a two speed action. When handle 30 is near to its extended position (FIG. 2) high leverage is provided. This allows a required clamping force. When the handle is nearer to its retracted position (FIG. 3) high speed is provided. This allows the clamp to close quickly without using a second hand to manually move the bar. Because of the high relative speed as in FIG. 3 a small motion of handle 30 gives a large motion of bar 60. More than two distinct fulcrums could be provided, in the extreme a continuously curved fulcrum between 32 and 33 would cause a continuously changing leverage.

A very large handle motion could give both high force and high speed, but this would require an unreasonable gripping distance. Using the moving fulcrum described above allows high speed and high force within a comfortable hand grip area. Friction in the operation is low since there is little sliding between the components. In FIG. 2, fulcrum 33 is nearly aligned with a line connecting pivots 19 and 35. Similarly in FIG. 3, fulcrum 32 is not far from the same imaginary line. Fulcrums 32 and 33 therefore move in nearly the same direction as the corresponding contact surfaces of lever 70. This is a similar effect as described above for pivot 19 relative to contact 71 against the wedge, whereby sliding is minimized.

Figure 4:
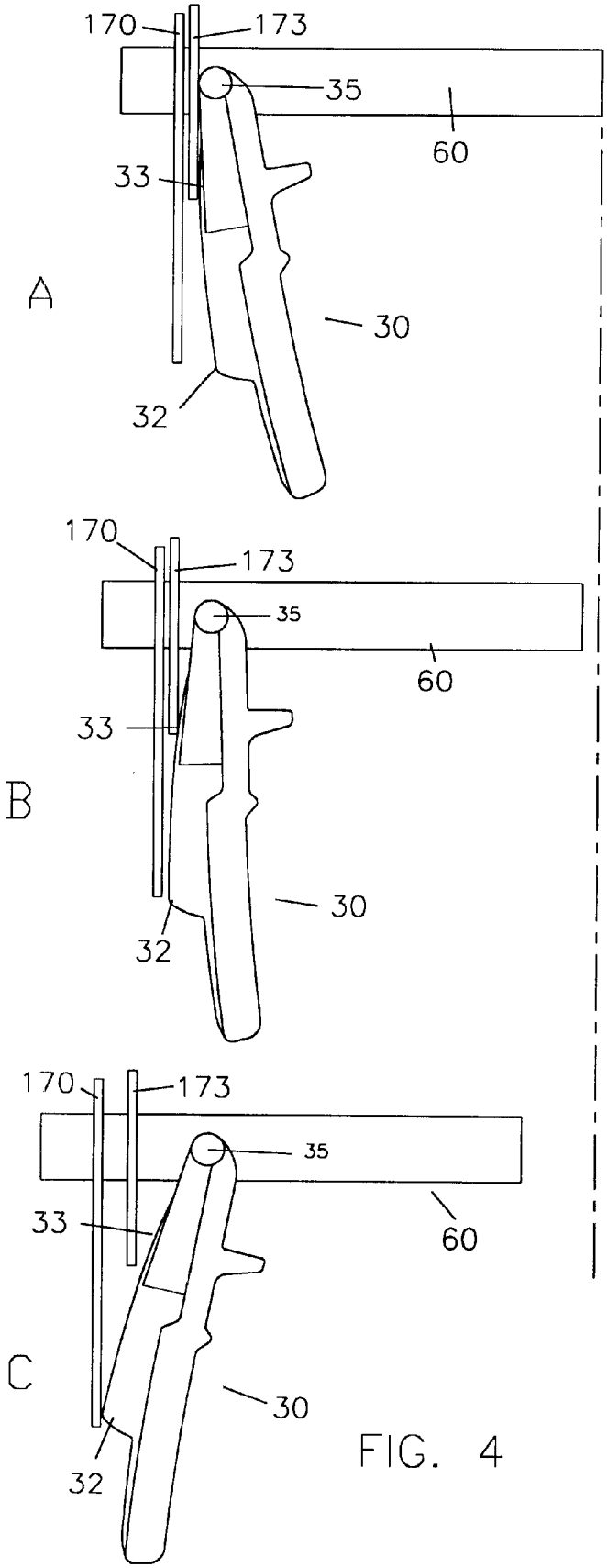
FIG. 4A, B, and C are schematic representations of an alternate embodiment varying leverage clamping mechanism.

In FIG. 4 an alternate embodiment of a two speed action is shown. In this design two separate rigid drive wedge bars are used. A first shorter bar 173 contacts fulcrum 33 to give the high force mode. A longer bar 170 contacts fulcrum 32 to give the high speed mode. A lever element is not used in this design since the moving fulcrum works directly on the wedge bars. The wedge bars define the fulcrum locations, so well defined contours at fulcrums 32 and 3.3 on handle 30 may not be required. FIG. 4 shows that bars 170 and 173 are not required to hold a particular spacing to each other. As with the embodiment of FIGS. 2 and 3, the force or speed mode depends on the position of the handle and is not related to the clamping force. Wedge bar 173 could be the same length as bar 170 if bar 173 included a bend in its length to create a fulcrum location.

In a return stroke from the condition of FIG. 3 to that of FIG. 2, wedge 90*b* is moved forward by spring end 82. Lever 70 and handle 30 are in turn moved forward; To prevent binding of wedge 90*b* during the return stroke the bottom of wedge 90*b* must not move forward of the wedge top, as it would then become effectively a forward drive stroke. As described above the relative position of spring end 82 above lever contact 71 ensures the correct wedge angle so that opening 91 maintains clearance about bar 60 during a return stroke. Also since spring end 82 "pulls" contact 71 from in front, wedge 90*b* will stay in contact with both contacts 71 of lever 70 and resist twisting as it returns. At the termination of the return stroke the top of wedge 90*b* contacts rib 12 of housing 10. The slight looseness described above when the handle is fully extended means that wedge 90*b* rotates slightly bottom forward in FIG. 2 from the action of rib 12. Lever 70 moves forward to close the space shown behind fulcrum 33 in FIG. 2. There is then clearance between bar 60 and opening 95 of drive wedge 90*b* so that bar 60 can move forward through drive wedge 90*b* when lock wedge 90*a* is released. In fact fulcrum 33 will normally contact lever 70 in FIG. 2, while handle 30 will have some freeplay until wedge 90*b* rotates about rib 12 enough to bind bar 60 in the drive stroke.

Extension 36 of handle 30 is a support surface. The bottom of extension 36 is relatively parallel to bar 60. As jaw end 20 is extended, the cantilevered weight from bar 60 causes handle 30 to be forced down against the gripping fingers. Extension 36 rests on a top gripping finger and prevents handle 30 from sliding down in a user's hand. Since extension 36 protrudes substantially directly forward, the gripping finger will not slide from under extension 36 easily as handle 30 is released quickly forward. In a further embodiment, not shown, extension 36 could hook downward to provide further support against the finger sliding out. Recess 9 of housing 10 is at the same height as the space under extension 36 relative to bar 60. The hand can grip the tool immediately under bar 60 where both the tool body and the handle are supported by the gripping hand.

Figure 8:
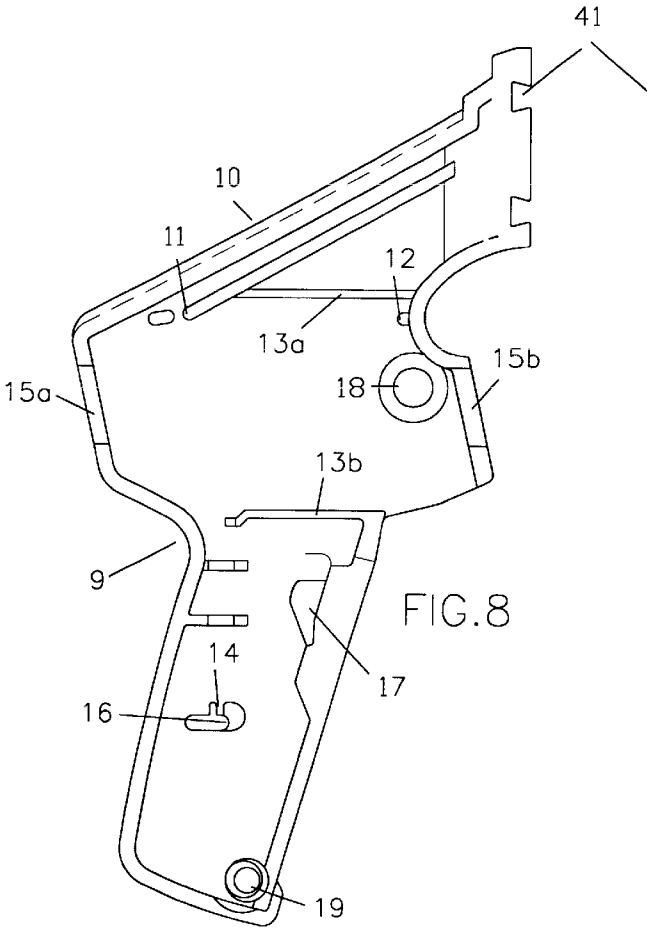
FIG. 8 is a side elevation of the interior of a housing left half.

Handle pivots 35 rotate within recesses 18, FIG. 8, of housing 10.

Bar 60 is removable without dislocation of any internal parts. Ribs 13 aand 13*b*, most visible in FIG. 8, locate wedge 90*b* in its vertical position when bar 60 is removed. Ribs 13 could equivalently be slots receiving extended tabs, not shown, of wedges 90. The walls of housing 10 position the wedge side to side.

Rear lock wedge 90*a* is similarly held. The function of ribs 13 could be served by further elements of the tool. For example in FIGS. 2 and 3 together with FIG. 8 it can be seen that the lower edge of wedge 90*a* is positioned by the top of release tab 50. Any element of the tool that is nearby wedges 90, other than bar 60, could be designed to position wedges 90 within housing 10 when bar 60 is removed.

Spring 30 is also fully held in position against wedge 90*b* independent of bar 60. The coil of torsion spring 30 is held around pivot 19. The position of spring end 82 is fixed relative to housing pivot 19. Therefore even if the tool is dropped when bar 60 has been removed, wedge 90*b* and spring 30 will not be dislodged. Similarly the position of spring end 81 is also fixed so that the spring that biases lock wedge 90*a* cannot be dislodged. Pivot 19 may be a post or other equivalent structure. This is an improvement from the prior art wherein no wedge bias spring is shown that has a pressing end secured in position against the wedge independently of the bar. This method to position the spring is shown schematically in FIG. 17. Spring end 182 is held against a stop of a housing. Post 119 positions the spring coil. Spring end 181 cannot slide up or down along wedge plate 175, except as caused by the arc of rotation of spring end 181.

A torsion spring is desirable compared to a more conventional compression spring since it is more compact in the area of bar 60. When used for a long drive stroke as in the present invention the torsion spring will have a lower spring rate with the effect that the reaction force will remain low when drive wedge 90*b* is rearmost. A long stroke compression or extension spring would be difficult to fit in the vicinity of bar 60.

Figure 18A:
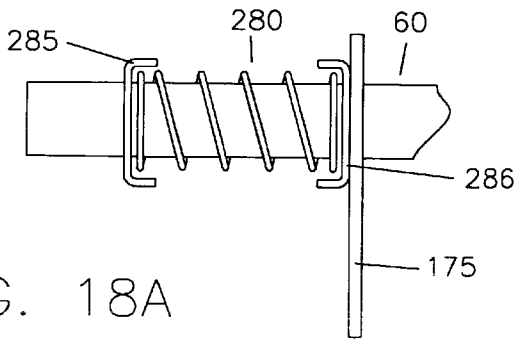
FIG. 18A is a schematic representation of a compression bias spring held in position against a wedge plate by one method.
Figure 18B:
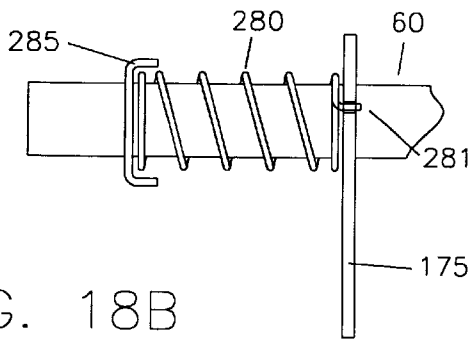
FIG. 18B is a schematic representation of a compression bias spring held in position against a wedge plate by a second method.

However if a compression spring were desired, FIG. 18A shows a method to secure such a spring independently from the bar. In this embodiment, spring 280 is held at both ends by cups, recesses or ribs 285 and 286 respectively. Cup 286 may be outside as shown or inside the spring. Cup 286 is fixed to wedge plate 175. Wedge plate 175 may be either a drive wedge or a lock wedge in this example. Wedge plate 175 is further held in the tool body by, for example, ribs 13 of FIG. 8. In a further embodiment spring 280 could include an upturned end wire 281, FIG. 18B, such that a segment of the spring extends beyond the spring body to form a locating tab. Such a tab may extend through a hole, recess or other feature of plate 175 to fix the end of spring 280 to plate 175. Preferably the hole is not a recess in the binding surface of opening 91 in wedge 90. Instead for example, the hole is beside, rather than atop or below, bar 60 as shown in FIG. 18B. The designs of FIG. 18A and 18B contrast with that of U.S. Pat. No. 5,161,787 discussed earlier where a compression spring is secured only at its non-moving end. As noted, the end contacting the drive plate is not well secured in this reference especially if the bar is removed and the stroke is long.

Figure 17:
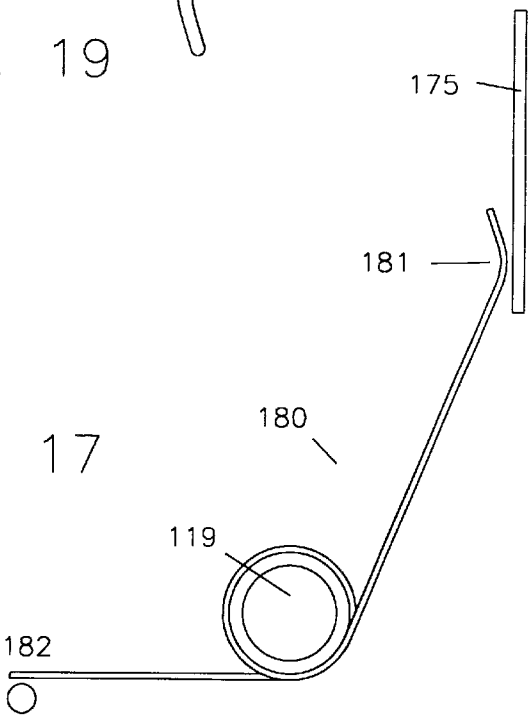
FIG. 17 is a schematic representation of a torsion bias spring assembly.

Other locations to hold the coil of torsion spring 30 may be used. However as illustrated in FIG. 17, if the coil is too far behind the plate the spring end arc will cause the spring to slide far down the plate. Referring back to FIG. 2, if the spring pivot were farther behind post 19, as in FIG. 17, spring end 82 would move down closer to lever contact 71. The required angle bias discussed above would be reduced. Therefore in a preferred embodiment both lever 30 and spring 80 are pivoted about the same location at post 19.

Figures 5, 6, 7:
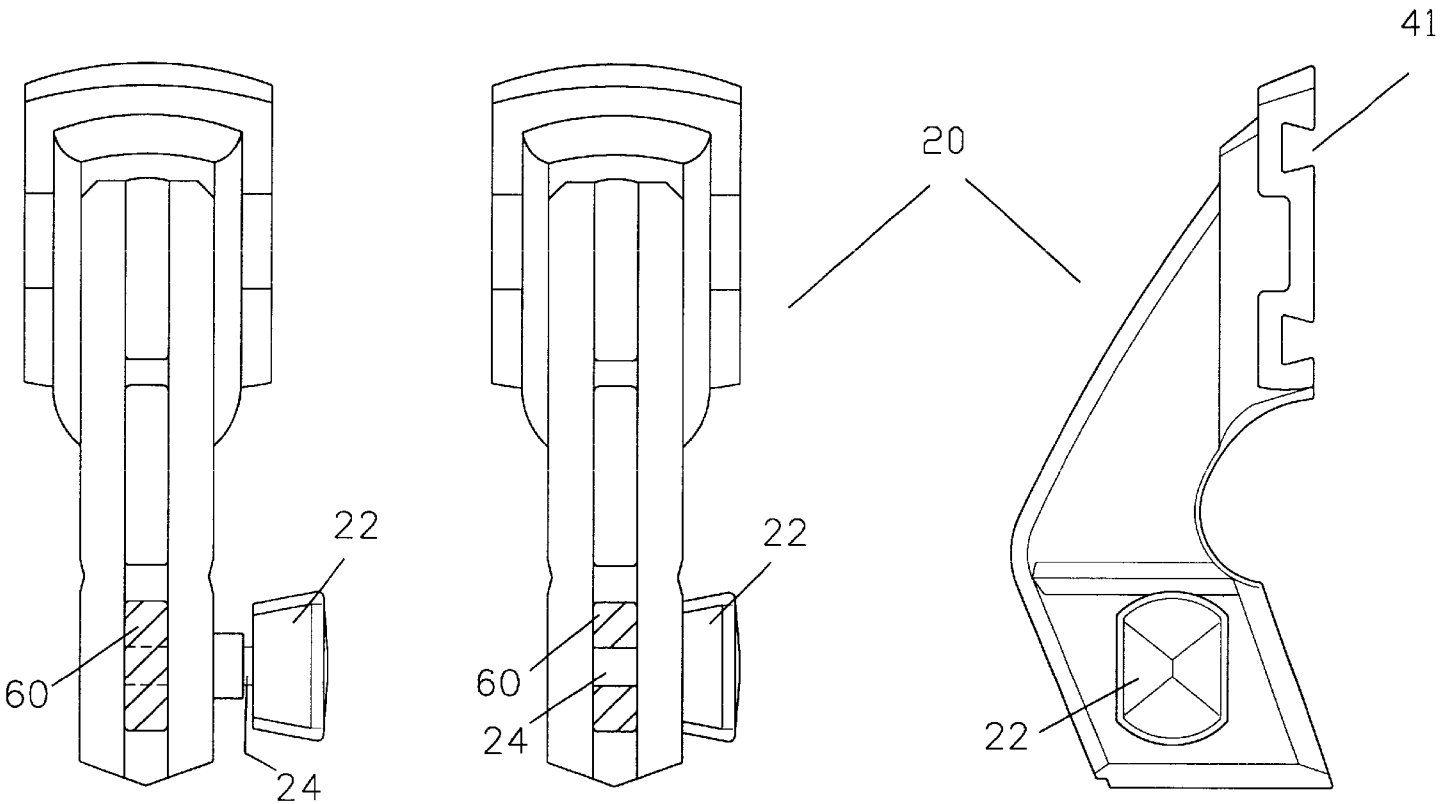
FIG. 5 is an end view of a clamp jaw end showing a release knob and pin disengaged from a bar.
FIG. 6 is the jaw end of FIG. 5, with the pin inserted through the bar.
FIG. 7 is a side elevation of the jaw end of FIGS. 5 and 6.

Most advantageously jaw end 20 is removable from the front end of bar 60. Bar 60 may have holes 65 (FIG. 1) or equivalent engaging features. At a rear end a pin stop may be pressed into hole 65 to prevent bar 60 from falling out of housing 10 in use. Jaw end 20 includes knob 22, FIGS. 5, 6, and 7. Pin 24 extends from knob 22 and slidably through a hole or cavity in the body of jaw end 20 and through a hole similar to hole 65 in bar 60. Bar 60 is shown in FIGS. 5 and 6 filling a cavity or slot in jaw end 20. When knob 22 is pulled jaw end 20 is free to slide off bar 60. The front of bar 60 then has a constant sectional area without obstructions or protrusions, such as a pin stop, to prevent it being pulled out of housing 10 through openings 15*a* and 15*b*. Knob 22 with pin 24 preferably has a stop so that it does not separate from jaw end 22 as it is pulled outward. A different length bar may then be pushed through housing 10 and attached to jaw end 20. It is normally helpful to press release button 53 as bar 60 is installed from the rear. Further, jaw end 20 and bar 60 may be installed oppositely so that jaw end is to the rear of housing 10. Jaw end must reversed on bar 60 so that pad 41 of the jaw end faces away from the tool body. The clamp is then a spreading device.

If desired, a pin at hole 65 could be removable. Then bar 60 could be removed and installed from either direction. Jaw end 20 could further be permanently fixed to bar 60. But then a complete assembly of bar and jaw end would have to be exchanged to change bar length. Also the option to reverse the jaw end and convert the tool to a spreading device would be lost.

Lock wedge 90*a* provides the clamp locking force. In the illustrated embodiment lock wedge 90*a* and drive wedge 90*b* are identical for manufacturing convenience. The design of the preferred embodiment clamp as shown in FIGS. 2 and 3 is especially intended to enable use of identical wedges. Stop 11 of housing 10 holds the top of flange 95 of wedge 90*a* in a pivoting relationship and prevents wedge 90*a* from moving forward. End 81 of spring 80 provides a stationary forward bias to the bottom of rear wedge 90*a*. Wedge 90*a* thus binds bar 60 within opening 91 when jaw end 20 is forced forward. Wedge 90*a* could be biased by a separate spring. However for assembly convenience the illustrated embodiment shows end 81 as part of a single piece spring 80. Spring 80 is deflected about rib 16 in housing 10. As seen in FIG. 14, the rear arm of spring 80 is normally straight. Rib 16 causes a deflection in the spring shape. Using a straight segment helps maintain a tight tolerance in the bias force since with a bend, the bend angle can vary.

To release jaw 20 and bar 60, the bottom of lock wedge 90*a* is forced rearward. Various methods to release wedge 90*a* may be used. For example a protruding tab of flange 95 of wedge 90*a* (not shown) could extend through an opening in housing 10 so that the tab is pulled rearward directly. Such tabs could be on each side of the housing. Further lock wedge 90*a* could extend upward past stop 11 and out of the top of housing 10. Such extension would be forced forward to rotate wedge 90*a* and release the bar. Further wedge 90*a* could be held against a stop in the housing from the bottom, and wedge 90*a* would be released by pressing a top end rearward.

Figure 10:
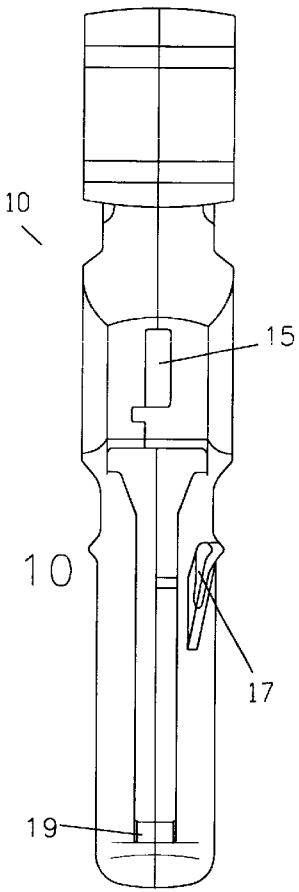
FIG. 10 is a front elevation of an assembled housing body.
Figure 9:
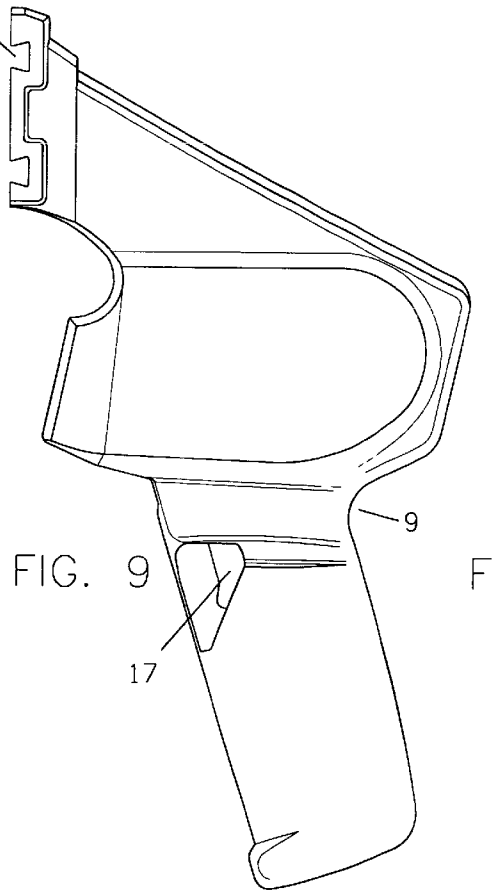
FIG. 9 is an external view of the housing of FIG. 8.
Figure 12:
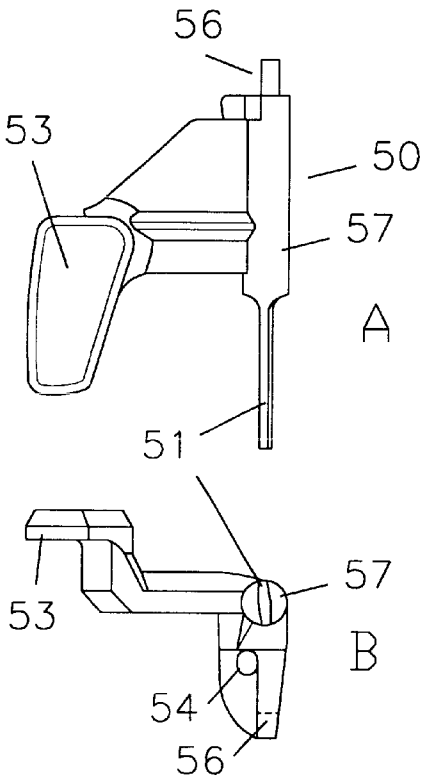
FIGS. 12A and B are side and top edge elevations respectively of a release tab.

In the preferred embodiment release tab 50 is a separate plastic element of the tool. As illustrated in FIGS. 2, 3, and 12, tab 50 is mounted within housing 10. Ribs of housing 10 hold tab 50 rotatably about hinge post 57. Pressing tab button 53 toward housing 10, (FIG. 10) causes tab 50 to rotate within housing 10. Extension 56 of tab 50 moves rearward, left in FIGS. 2 and 3, and presses flange 95 of wedge 90*a* forcing the lower end of wedge 90*a* rearward. Wedge 90*a* pivots slightly about its top end at stop 11 and disengages bar 60. Tab 50 may include a reinforcing structure surrounding a hole 54, FIG. 12B, where hole 54 allows spring end 81 to pass through. Flat torsion bar 51 of tab 50 engages slot 14 of housing 10. Bar 51 provides a spring bias to hold button 53 away from housing 10 and prevent rattle of tab 50. Tab 50 passes through opening 17 in housing 10.

Figure 19:
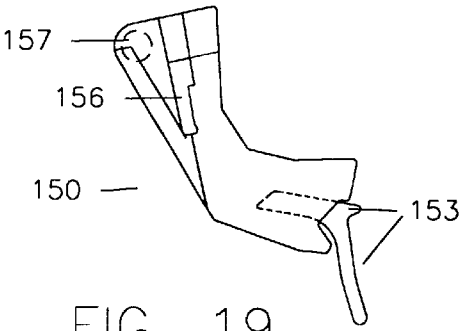
FIG. 19 is a side elevation of an alternate embodiment release tab.

An alternate embodiment release tab 150 is shown in FIG. 19. Rather than pressing inward to housing 10, pressing surfaces 153 are rotated down the outside of the housing. Tab 150 pivots about pivot 157 at a location within the tool body. Rotation of tab 150 causes the front edge of slot 156 to engage the lower end of flange 95 of lock wedge 90*a*. As with extension 56 of tab 50, slot 156 forces the lower end of wedge 90*a* rearward.

By locating release tab 50 on the side of the tool it is not necessary to move the operating hand between a drive position around handle 30 and a release position upon tab 50. In right handed use the thumb operates button 53. In left hand use the middle finger can easily press button 53 while support of the handle is maintained with the index finger.

In is not required that the release tab is pivotably attached to housing 10. For example a release tab could slide within or against the housing or other element, and the motion of the tab would be linked lock wedge 90*a* to cause wedge 90*a* to release from bar 60.

What is claimed is:

1. A quick action bar clamp including a housing, a clamping surface extending from the housing, a bar slidably disposed through openings in a front and a rear of the housing, an elongated handle pivotably attached to the housing toward the front of the housing at a handle pivot, the handle projecting away from the bar toward a bottom of the housing, a jaw end attached to a front end of the bar whereby rotating the handle toward the housing causes the jaw end to be drawn toward the housing, wherein:

a drive wedge binds against the bar;

a lever is pivotably attached to the housing near the bottom of the housing;

the lever contacts the drive wedge at a lever upper end;

a rear surface of the handle presses a front face of the lever at at least an upper and a lower fulcrum location along a length of the lever, the handle pressing the upper fulcrum location when the handle is in an extended position away from the housing, and the handle pressing the lower fulcrum location when the handle is in a retracted position near the housing;

the upper fulcrum defining a high force operation mode wherein a large motion of the handle produces a small motion of the drive wedge, and the lower fulcrum defining a high speed operation mode wherein a small motion of the handle produces a large motion of the drive wedge.

2. The bar clamp of claim 1 wherein the front face of the lever is substantially straight and the fulcrum locations are defined by contours of the rear surface of the handle.

3. The bar clamp of claim 1 wherein a torsion spring biases the drive wedge forward, and an arm of the torsion spring presses a rear surface of the drive wedge at a location above the lever upper end.

4. A quick action clamp including a housing, a clamping surface extending from the housing, an elongated horizontal bar slidably disposed within the housing, a handle pivotably attached to the housing at a handle pivot, a drive wedge surrounding the bar, the handle linked to the drive wedge where rotating the handle causes the drive wedge to bind the bar and the drive wedge to move along with the bar in a first horizontal direction, a drive spring pressing the drive wedge at a drive spring pressing end and biasing the drive wedge in a second horizontal direction, the drive spring pressing end and the drive wedge moving in the second horizontal direction in a return stroke action, a lock wedge surrounding the bar, a lock spring pressing the lock wedge at a lock spring pressing end and normally biasing the lock wedge to bind against the bar to prevent the bar from moving in the second horizontal direction, wherein the bar is removable from the housing by sliding the bar out of the housing, and when the bar is removed from the housing:

each of the drive wedge and the lock wedge is substantially fixed in a vertical direction within the housing by ribs of the clamp;

the drive spring pressing end is held in a location against the drive wedge;

and the lock spring pressing end is held in location against the lock wedge.

5. The clamp of claim 4 wherein the drive spring is a torsion spring and an end of an arm of the torsion spring comprises the drive spring pressing end.

6. The clamp of claim 5 wherein a coil of the torsion spring is rotatably fixed about a post of the housing, and when the drive wedge moves along the bar the drive spring pressing end rotates about the post of the housing.

7. The clamp of claim 6 wherein a second arm of the torsion spring includes a lock spring pressing end.

8. The clamp of claim 7 wherein the second arm is a straight segment and it presses a rib of the housing at a location of the second arm between the coil and the lock spring pressing end.

9. The clamp of claim 4 wherein the spring is a compression spring, and the spring pressing end is held in a fixed position against the drive wedge.

10. The clamp of claim 9 wherein the spring pressing end is held in position against the wedge by ribs attached to the drive wedge.

11. The clamp of claim 9 wherein a tab of the spring pressing end engages a recess in the drive wedge.

12. The clamp of claim 4 wherein the bar includes a detachable jaw end.

13. The clamp of claim 12 wherein the jaw end can be attached to the bar with a clamping surface of the jaw end facing either toward the clamping surface of the housing or facing away from the clamping surface of the housing.

14. The clamp of claim 12 wherein the bar is fitted within a slot of the jaw end, a pin extends into a cavity of the jaw end and into the slot and the pin extends through a hole in the bar whereby the pin prevents the jaw end from sliding along the bar when the pin is within the hole in the bar, the jaw end is slidable along a length of the bar when the pin is withdrawn from the hole in the bar.

15. The clamp of claim 14 wherein the pin includes a stop to limit a withdrawal motion so that the pin cannot become separated from the jaw end.

16. The clamp of claim 12 wherein the bar includes a substantially constant transverse cross sectional area in an end segment of the bar to which the jaw end is attached, and the end segment of the bar is free of obstructions against sliding the bar out from the housing.

17. A quick action clamp including a housing, an elongated horizontal bar slidably disposed within the housing, a handle pivotably attached to the housing at a handle pivot, an elongated drive wedge surrounding the bar, the handle linked to the drive wedge where rotating the handle toward the housing causes the drive wedge to be pressed near one end to bind the bar and to cause the drive wedge to move along with the bar in a first horizontal direction, the drive wedge moving in a second horizontal direction in a return stroke action, an elongated lock wedge surrounding the bar and pivotably pressing the housing at one end of the lock wedge, the lock wedge normally binding against the bar to prevent the bar from moving in the second horizontal direction, at least one wedge being formed in an out-of-plane shape including a bent channel transverse cross section.

18. The clamp of claim 17 wherein the transverse cross section describes a U channel shape.

19. The clamp of claim 18 wherein the channel shape includes outwardly extending flanges.

20. The clamp of claim 19 wherein, when the handle is rotated, flanges of the drive wedge are pressed at a contact location near one end of the wedge in the first horizontal direction, a bias spring presses within the channel in the second horizontal direction, the second horizontal direction facing a front of the clamp, and the spring presses the drive wedge at a location forward of the contact location.

21. The clamp of claim 17 wherein the drive wedge and the lock wedge are identical to each other.

22. A quick action clamp including a housing, an elongated horizontal bar slidably disposed within the housing, a handle pivotably attached to the housing at a handle pivot, an elongated drive wedge surrounding the bar, the handle linked to the drive wedge where rotating the handle causes the drive wedge to be pressed near one end to bind the bar and to cause the drive wedge to move along with the bar in a first horizontal direction, the drive wedge moving in a second horizontal direction in a return stroke action, an elongated lock wedge surrounding the bar and pivotably pressing the housing at one end of the lock wedge, the lock wedge normally binding against the bar to prevent the bar from moving in the second horizontal direction, wherein the lock wedge is substantially enclosed by side walls of the housing, the lock wedge binds the bar rearward of the drive wedge, a release tab extends from the housing and is exposed on at least one side of the housing, the release tab being linked to the lock wedge such that moving the release tab causes the lock wedge to release from the bar.

23. The bar clamp of claim 22 wherein the release tab is a separate element from the lock wedge, the release tab is linked to the lock wedge, the release tab is pivotably attached within the housing, and pressing a surface of the release tab causes the lock wedge to release the bar.

24. The bar clamp of claim 23 wherein pressing the surface of the release tab toward the housing causes the lock wedge to release the bar.

25. The bar clamp of claim 22 wherein a surface of the release tab is exposed on a side of the housing.

* * * * *